US006215071B1

(12) United States Patent
Kasahara et al.

(10) Patent No.: US 6,215,071 B1
(45) Date of Patent: Apr. 10, 2001

(54) FLAT CABLE AND PROCESS FOR PRODUCING THE SAME

(75) Inventors: Tsukasa Kasahara; Osamu Mochizuki; Masaaki Aoyagi; Satoshi Mizushima, all of Ibaraki (JP)

(73) Assignee: Hitachi Cable Ltd., Tokyo (JP)

( * ) Notice: Subject to any disclaimer, the term of this patent is extended or adjusted under 35 U.S.C. 154(b) by 0 days.

(21) Appl. No.: 09/357,953

(22) Filed: Jul. 21, 1999

(30) Foreign Application Priority Data

Apr. 22, 1999 (JP) ..... 11-114773

(51) Int. Cl.[7] ..... H01B 11/02

(52) U.S. Cl. ..... 174/117 F; 174/117 FF; 174/27

(58) Field of Search ..... 174/36, 32, 34, 174/117 F, 117 FF, 27

(56) References Cited

U.S. PATENT DOCUMENTS 4,404,424 * 9/1983 King et al. ..... 174/34
4,413,469 * 11/1983 Paquin ..... 57/293
4,767,891 * 8/1988 Biegon et al. ..... 174/34
4,837,405 * 6/1989 Bonjour et al. ..... 174/36
4,992,625 * 2/1991 Izui et al. ..... 174/36
5,142,105 * 8/1992 Kihlken et al. ..... 174/112

* cited by examiner

*Primary Examiner*—Kristine Kincaid
*Assistant Examiner*—William H. Mayo, III
(74) *Attorney, Agent, or Firm*—Scully, Scott Murphy & Presser

(57) ABSTRACT

In a flat cable including fused portions and twisted pair portions, the length of the twisted pair portions being not constant, the twist pitch of the twisted pair portions being substantially constant independently of the length of the twisted pair portions, some of the twisted pair portions being constituted by S twists with the other twisted pair portions being constituted by Z twists, the next twisted pair portion is twisted in such a manner that, when the number of twists in the S twisted pair portions in the longitudinal direction of the flat cable is added as "plus (+)" value with the number of twists in the Z twisted pair portions being added as "minus (−)" value, the twist sense in the next twisted pair portion is Z twist sense if the integrated value of the number of twists is plus (+) while the twist sense in the next twisted pair portion is S twist sense if the integrated value of the number of twists is minus (−). By virtue of the above constitution, a flat cable with the spacing of fused portions being not constant can be produced without requiring any twist back mechanism.

2 Claims, 4 Drawing Sheets

FLAT CABLE AND PROCESS FOR PRODUCING THE SAME

FIELD OF THE INVENTION

The invention relates to a flat cable, and more particularly to a flat cable comprising fused portions and twisted pair portions and a process for producing the same.

BACKGROUND OF THE INVENTION

In commercially available flat cables comprising fused portions and twisted pair portions, the fused portions to be connected to a connector are disposed at equal spacings with each of the fused portions being sandwiched between the twisted pair portions.

In the twisted pair portions in this type of flat cables, adjacent twisted pairs are twisted in directions opposite to each other from the viewpoint of preventing crosstalk. When attention is drawn to one twisted pair, however, in some of this type of flat cables, the twisted pair portions sandwiching the fused portion are twisted in directions opposite to each other, while in the other flat cables of this type, the twisted pair portions sandwiching the fused portion are always twisted in the same direction. This difference is attributable to a difference in the production system.

An example of the construction of the system for producing flat cables will be explained.

A system for producing a flat cable comprises: a feeder for delivering insulated conductors for a flat cable at even tension; a twister for twisting two insulated conductors to each other to form a twisted pair; a fusing device for fusing all the insulated conductors to one another to form a fused portion with the insulated conductors being juxtaposed to each other; a take-up unit for taking up at a constant speed insulated conductors that have been subjected to pair twisting and fusing; a coiler for winding the cable around a bobbin; a controller for controlling the operation and stopping of the twister and for controlling the operation and stopping of the fusing device; and the like.

In the flat cable wherein the twisted pair portions sandwiching the fused portion are twisted in directions opposite to each other, during the formation of a certain twisted pair portion, twist is accumulated in the insulated conductors between the twister and the feeder. Since, however, twisting is carried out in the opposite direction in the formation of the next twisted pair portion, the accumulation of the twist is eliminated. On the other hand, in the flat cable wherein the twisted pair portions sandwiching the fused portion are always twisted in the same direction, the twist between the twister and the feeder is increasingly accumulated. The twist cannot be infinitely accumulated in the insulated conductors between the twister and the feeder. Therefore, a twist back mechanism for eliminating the twist should be provided at the delivery portion.

The twist back mechanism should be provided in number equal to the number of pairs. In some of actual flat cables, the number of pairs is 50 or 100. This incurs very high cost for the provision of the twist back mechanisms.

The conventional flat cables described above are produced on the premise that the mounting spacings of the connector are constant. In recent years, however, there is a demand that the connector is provided at different mounting spacings in one cable, for example, at mounting spacings of 125 mm, 250 mm, 325 mm and the like. In order to meet the above demand, when a cable with the fused portions being provided at spacings of 125 mm and 250 mm is taken by way of example, if the length of the fused portions is 50 mm with the pitch of the twisted pairs being 25 mm, the number of twists is 3 in the portion having a fused portion spacing of 125 mm and 8 in the portion having a fused portion spacing of 250 mm. In the production of a cable wherein the portion with the number of twists being 3 is provided alternately with the portion with the number of twists being 8, when the twist sense is changed for the formation of each of the fused portions as described above, twist is increasingly accumulated between the feeder and the twister. This ultimately requires the provision of twist back mechanisms.

SUMMARY OF THE INVENTION

The present inventors have found that the accumulation of the twist can be minimized by independently regulating the twist sense of the twisted pair portions.

Accordingly, it is an object of the invention to provide a flat cable with the spacings of fused portions being not constant that can be produced without any twist back mechanism, and to provide a process for producing the same.

Thus, according to the first feature of the invention, a flat cable comprises fused portions and twisted pair portions, the length of the twisted pair portions being not constant, the twist pitch of the twisted pair portions being substantially constant independently of the length of the twisted pair portions, some of the twisted pair portions being constituted by S twisted pair portions with the other twisted pair portions being constituted by Z twisted pair portions, twisting in the twisted pair portions having been carried out in such a manner that, when the number of twists in the S twisted pair portions in the longitudinal direction of the flat cable is added as "plus (+)" value with the number of twists in the Z twisted pair portions being added as "minus (−)" value, the twist sense in the next twisted pair portion is Z twist sense if the integrated value of the number of twists is plus (+) while the twist sense in the next twisted pair portion is S twist sense if the integrated value of the number of twists is minus (−).

The determination of the twist sense in the twisted pair portions by the above method permits the twist accumulated in insulated conductors between the feeder and the twister to be suppressed to a given extent or less. This in turn eliminates the need to provide any twist back mechanism in the delivery portion even when various fused portion spacings are provided, contributing to reduced production system cost. Further, also for the controller regarding pair twisting, the twist sense of the twisted pair portion is determined based on the integrated value obtained by adding up or subtracting the number of twists according to the twist sense. This eliminates the need to consider the number of twists in the next twisting or to previously determine the twist sense and hence can save a lot of time and labor.

According to the second feature of the invention, there is provided a process for producing a flat cable comprising fused portions and twisted pair portions, the length of the twisted pair portions being not constant, the twist pitch of the twisted pair portions being substantially constant independently of the length of the twisted pair portions, wherein twisting of the twisted pair portions is carried out in S twist sense or Z twist sense based on the integrated value of twists in the twisted portions determined in such a manner that when twisting in the twisted pair portion is carried out in the S twist sense, the number of twists is added to the integrated value while when twisting in the twisted pair portion is carried out in the Z twist sense, the number of twists in the twisted pair portion is subtracted from the integrated value and wherein, in initiating the S twisting of the twisted pair portions, when the integrated value of twists in the twisted pair portions is plus (+), twisting is carried out in the Z twist sense while when the integrated value of twists in the twisted pair portions is minus (−), twisting is carried out in the S twist sense.

BRIEF DESCRIPTION OF THE DRAWING

The invention will be explained in more detail in conjunction with the appended drawings, wherein.

DESCRIPTION OF THE PREFERRED EMBODIMENTS

Before describing the flat cable according to the preferred embodiment of the invention, the conventional flat cables will be explained in FIGS. 1 and 2.

Figure 1:
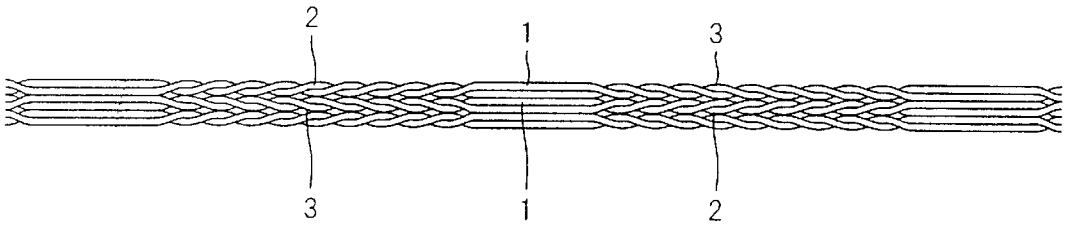
FIG. 1 PRIOR ART
FIG. 1 is an explanatory view of a conventional flat cable.
Figure 2:
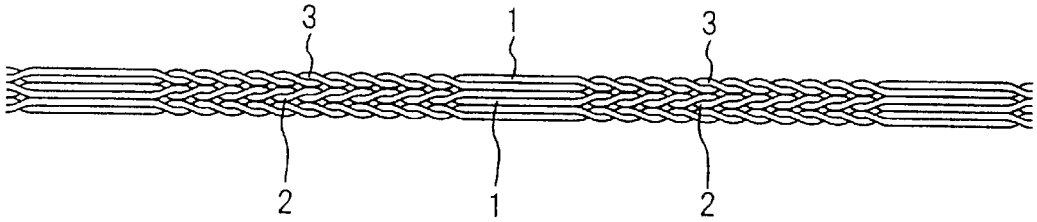
FIG.2 PRIOR ART
FIG. 2 is an explanatory view of another conventional flat cable.

Among flat cables comprising fused portions and twisted pair portions, currently commercially available flat cables are shown in FIGS. 1 and 2. In both the flat cables shown in FIGS. 1 and 2, the fused portions 1 to be connected to a connector are disposed at equal spacings with each of the fused portions being sandwiched between the twisted pair portions 2, 3.

In the twisted pair portions in this type of flat cables, adjacent twisted pairs are twisted in directions opposite to each other from the viewpoint of preventing crosstalk. When attention is drawn to one twisted pair, however, in the flat cable shown in FIG. 1, the twisted pair portions 2, 3 sandwiching the fused portion 1 are twisted in directions opposite to each other, while in the flat cable shown in FIG. 2, the twisted pair portions 3, 3 sandwiching the fused portion 1 are always twisted in the same direction. This difference is attributable to a difference in the production system.

An example of the construction of the system for producing flat cables will be explained in FIG. 4.

Figure 4:
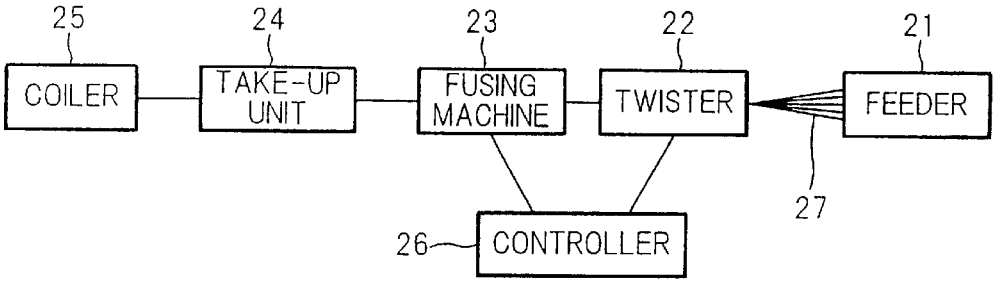
FIG. 4 is an explanatory view showing the construction of a system for producing a flat cable.

A system for producing a flat cable shown in FIG. 4 comprises: a feeder 21 for delivering insulated conductors for a flat cable at even tension; a twister 22 for twisting two insulated conductors to each other to form a twisted pair; a fusing device 23 for fusing all the insulated conductors to one another to form a fused portion with the insulated conductors being juxtaposed to each other; a take-up unit 24 for taking up at a constant speed insulated conductors that have been subjected to pair twisting and fusing; a coiler 25 for winding the cable around a bobbin; a controller 26 for controlling the operation and stopping of the twister 22 and for controlling the operation and stopping of the fusing device 23; and the like.

In the flat cable shown in FIG. 1 wherein the twisted pair portions sandwiching the fused portion are twisted in directions opposite to each other, during the formation of a certain twisted pair portion, twist is accumulated in the insulated conductors in a portion 27 between the twister 22 and the feeder 21. Since, however, twisting is carried out in the opposite direction in the formation of the next twisted pair portion, the accumulation of the twist is eliminated. On the other hand, in the flat cable shown in FIG. 2 wherein the twisted pair portions sandwiching the fused portion are always twisted in the same direction, the twist in the portion 27 between the twister 22 and the feeder 21 is increasingly accumulated. The twist cannot be infinitely accumulated in the insulated conductors in the portion 27 between the twister 22 and the feeder 21. Therefore, a twist back mechanism for eliminating the twist should be provided at the delivery portion.

The twist back mechanism should be provided in number equal to the number of pairs. In FIG. 2, the number of twists is shown as 3 for simplification. In some of actual flat cables, the number of pairs is 50 or 100. This incurs very high cost for the provision of the twist back mechanisms.

The conventional flat cables described above are produced on the premise that the mounting spacings of the connector are constant. In recent years, however, there is a demand that the connector is provided at different mounting spacings in one cable, for example, at mounting spacings of 125 mm, 250 mm, 325 mm and the like. In order to meet the above demand, when a cable with the fused portions being provided at spacings of 125 mm and 250 mm is taken by way of example, if the length of the fused portions is 50 mm with the pitch of the twisted pairs being 25 mm, the number of twists is 3 in the portion having a fused portion spacing of 125 mm and 8 in the portion having a fused portion spacing of 250 mm. In the production of a cable wherein the portion with the number of twists being 3 is provided alternately with the portion with the number of twists being 8, when the twist sense is changed for the formation of each of the fused portions based on the way of thinking as described above in connection with the flat cable shown in FIG. 1, twist is increasingly accumulated in the portion 27 between the feeder 21 and the twister 22. This ultimately requires the provision of twist back mechanisms.

Next, preferred embodiments of the invention will be explained in FIGS. 3 and 4.

Figure 3:
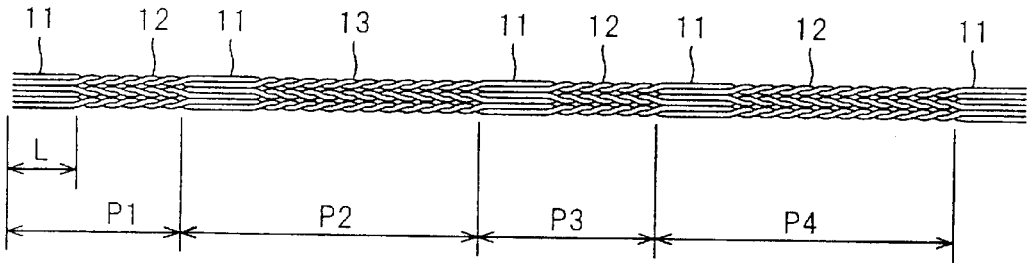
FIG. 3 is an explanatory view of the flat cable according to a preferred embodiment of the invention.

FIG. 3 is an explanatory view of the flat cable according to the invention. FIG. 4 is a diagram showing an example of the construction of a system for producing the flat cable.

In the production of the flat cable according to the invention, for example, a controller 26 for controlling a twister 22 is provided with a mechanism for integrating the number of twists. In this case, the number of twists is added when a certain twisted pair portion has been twisted in the S sense, while the number of twists is subtracted when a certain twisted pair portion has been twisted in the Z sense.

When the twist sense in the next twisted pair portion is determined after the formation of the fused portion 11, the twisting is carried out in the Z direction if the integrated number of twists is plus (+), while the twisting is carried out in the S direction if the integrated number of twists is minus (−). When the integrated value is zero (0), twisting may be carried out in any direction.

For example, in FIG. 3, when the spacings of 125 mm (P1, P3) and 250 mm (P2, P4) are repeated in the fused portions with the length (L) of the fused portions 11 and the twist pair pitch being 50 mm and 25 mm, respectively, in the initial state, the integrated value of twists is zero (0). Therefore, in the twisted pair portion 12 with the fused portion spacing being P1, twisting is carried out three times in the S sense. This brings the integrated value to +3. Therefore, in the twisted pair portion 13 with the fused portion spacing being P2, twisting is carried out eight times in the Z sense. This brings the integrated value to −5. Therefore, in the twisted pair portion 12 with the fused portion spacing being P3, twisting is carried out three times in the S twist sense. This brings the integrated value to −2, and, next, also in the twisted pair portion 12 with the fused portion spacing being P4, twisting is carried out eight times in the S sense. Since this brings the integrated value to +6, in the next twisted portion (not shown), twisting is carried out three times in the Z twist sense. The twist sense is determined in this way.

In FIG. 3, when the production of the flat cable is started from the left end portion, the twist sense in the twisted pair portions is S, Z, S, S, Z, Z . . . in that order.

According to this preferred embodiment, when no twist is accumulated at the time of the initiation of the production (the left end portion in FIG. 3), the number of twists accumulated in the course of the production process is up to 6. Even though worst comes to worst, the number of accumulated twists does not exceed the number of twists in the longest twisted portion.

As is apparent from the foregoing description, the present invention can provide a flat cable with the spacings of fused portions being not constant that can be produced without any twist back mechanism and can provide a process for producing the same.

The invention has been described in detail with particular reference to preferred embodiments, but it will be understood that variations and modifications can be effected within the scope of the invention as set forth in the appended claims.

What is claimed is:

1. A flat cable comprising fused portions and twisted pair portions, the length of the twisted pair portions being not constant, a twist pitch of the twisted pair portions being substantially constant independently of the length of the twisted pair portions, some of the twisted pair portions being constituted by S twisted pair portions with the other twisted pair portions being constituted by Z twisted pair portions, twisting in the twisted pair portions having been carried out in such a manner that, when a number of twists in the S twisted pair portions in the longitudinal direction of the flat cable is added as "plus (+)" value with a number of twists in the Z twisted pair portions being added as "minus (−)" value, a twist sense in the next twisted pair portion is Z twist sense if an integrated value of the number of twists is plus (+) while the twist sense in the next twisted pair portion is S twist sense if the integrated value of the number of twists is minus(−).

2. A process for producing a flat cable comprising fused portions and twisted pair portions, the length of the twisted pair portions being not constant, a twist pitch of the twisted pair portions being substantially constant independently of the length of the twisted pair portions, wherein twisting of the twisted pair portions is carried out in S twist sense or Z twist sense based on an integrated value of twists in the twisted portions determined in such a manner that when twisting in the twisted pair portion is carried out in the S twist sense, a number of twists is added to the integrated value while when twisting in the twisted pair portion is carried out in the Z twist sense, a number of twists in the twisted pair portion is subtracted from the integrated value and wherein, in initiating twisting in the twisted pair portion, when the integrated value of twists in the twisted pair portions is plus (+), twisting is carried out in the Z twist sense while when the integrated value of twists in the twisted pair portions is minus (−), twisting is carried out in the S twist sense.

* * * * *